US007549301B2

(12) United States Patent
Howard

(10) Patent No.: US 7,549,301 B2
(45) Date of Patent: Jun. 23, 2009

(54) AIR SEPARATION METHOD

(75) Inventor: Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 486 days.

(21) Appl. No.: 11/449,767

(22) Filed: Jun. 9, 2006

(65) Prior Publication Data

US 2007/0283719 A1 Dec. 13, 2007

(51) Int. Cl.
*F25J 3/00* (2006.01)

(52) U.S. Cl. ..... 62/646; 62/647; 62/924

(58) Field of Classification Search ..... 62/646, 62/643, 647, 924
See application file for complete search history.

(56) References Cited

U.S. PATENT DOCUMENTS

| | | | | |
|---|---|---|---|---|
| 4,372,764 | A | 2/1983 | Theobald | |
| 4,737,177 | A | 4/1988 | Erickson | 62/22 |
| 4,854,954 | A | 8/1989 | Erickson | |
| 4,883,519 | A | 11/1989 | Agrawa et al. | 62/39 |
| 4,927,441 | A | 5/1990 | Agrawal | 62/28 |
| 5,034,043 | A | 7/1991 | Rottmann | |
| 5,386,691 | A | 2/1995 | Bonaquist et al. | 62/25 |
| 5,469,710 | A | 11/1995 | Howard et al. | 62/22 |
| 5,611,219 | A * | 3/1997 | Bonaquist | 62/646 |
| 5,666,823 | A * | 9/1997 | Smith et al. | 62/646 |
| 5,666,824 | A * | 9/1997 | Bonaquist | 62/646 |
| 5,678,425 | A | 10/1997 | Agrawal et al. | |
| 5,682,766 | A * | 11/1997 | Bonaquist et al. | 62/646 |
| 5,692,396 | A | 12/1997 | Rathbone | |
| 5,956,973 | A | 9/1999 | Herron et al. | 62/646 |
| 6,279,345 | B1 * | 8/2001 | Arman et al. | 62/647 |
| 6,564,581 | B2 * | 5/2003 | Pompl | 62/646 |

FOREIGN PATENT DOCUMENTS

| | | |
|---|---|---|
| EP | 0 841 525 A2 | 5/1998 |
| EP | 1067345 A1 | 1/2001 |

* cited by examiner

*Primary Examiner*—William C Doerrler
(74) *Attorney, Agent, or Firm*—David M. Rosenblum

(57) ABSTRACT

Argon, oxygen and nitrogen contained within an incoming air feed is fractionated within an air separation system having a multiple column arrangement that includes a higher pressure column and a lower pressure column to produce oxygen and nitrogen-rich fractions and an argon column to produce an argon-rich fraction for recovery of the argon as an argon product. A two-phase stream can be formed by either expanding at least part of a liquid air stream or by a liquid oxygen column bottoms formed within a higher pressure column of the multiple column arrangement. The liquid air stream is formed by liquefying part of the air feed to be fractionated against vaporizing a pumped liquid stream composed of nitrogen and/or oxygen. The diversion of the nitrogen vapor contained in the nitrogen-rich fraction increases the liquid to vapor ratio within the lower pressure column to increase the argon recovery.

11 Claims, 2 Drawing Sheets

AIR SEPARATION METHOD

FIELD OF THE INVENTION

The present invention relates to a method of separating air in a multiple column arrangement having higher and lower pressure columns operatively associated in a heat transfer relationship and an argon column connected to the lower pressure column. More particularly, the present invention relates to such a method in which a liquid stream is introduced into the lower pressure column above the point at which an argon and oxygen-containing vapor stream is removed from the lower pressure column to improve the liquid to vapor ratio within the lower pressure column and thereby to improve argon recovery in the argon column.

BACKGROUND OF THE INVENTION

It has long been known to separate air in multiple column arrangements having higher and lower pressure columns to produce nitrogen and oxygen-rich fractions and an argon column to rectify an argon and oxygen-containing vapor stream taken from the lower pressure column to produce an argon-rich fraction.

In such air separation systems, air is compressed and purified to remove higher boiling impurities such as carbon monoxide, carbon dioxide and water. The resultant compressed and purified stream is cooled in a main heat exchanger to a temperature at or near the dew point of air and the resultant cooled stream is then introduced into the higher pressure column. The air is rectified in the higher pressure column to produce a nitrogen column overhead and a crude liquid oxygen column bottoms. The crude liquid oxygen column bottoms is then further refined within the lower pressure column to produce a liquid oxygen column bottoms and a nitrogen-rich column overhead.

The higher and lower pressure columns are operatively associated with one another in a heat transfer relationship by means of a condenser-reboiler that vaporizes a liquid oxygen column bottoms produced in the lower pressure column against condensing nitrogen column overhead in the higher pressure column to reflux the higher pressure column. A stream of the condensed nitrogen column overhead is then introduced into the lower pressure column for reflux purposes.

A vapor stream containing oxygen and argon is removed from the lower pressure column and is then rectified in the argon column to produce an argon-rich column overhead that can be extracted as a product or further refined to produce the argon product. The argon column is refluxed by a condenser. A stream of the crude liquid oxygen column bottoms is expanded to the pressure of the lower pressure column, thereby to also lower its temperature. Thereafter, at least a portion of this stream is then introduced into the condenser to condense some of the argon-rich column overhead. The resultant vaporization within the argon condenser produces vapor and liquid phases that are subsequently introduced into the lower pressure column.

The introduction of the vapor fraction derived from the crude liquid oxygen being introduced into the lower pressure column increases the nitrogen traffic within the lower pressure column and therefore decreases the amount of argon being washed down the column to the point at which the argon and oxygen-containing vapor stream is taken for further refinement in the argon column. This problem is exacerbated when liquid oxygen and nitrogen products are to be produced at pressure. For example, when liquid oxygen is taken for production of an oxygen product at pressure, a liquid oxygen stream may be pumped and then vaporized in the main heat exchanger. For such purposes part of the air is compressed in a booster compressor to thermally compensate for such vaporization. Liquefaction of the air taken for such purposes results in less nitrogen vapor being produced in the higher pressure column and therefore, less reflux to the lower pressure column.

In order to combat this problem, U.S. Pat. No. 5,386,691 provides for a portion of the vapor fraction produced in the argon column condenser to be valve expanded and redirected to the waste nitrogen stream. In so doing, the reflux ratio in the upper section of the lower pressure column is increased thereby increasing argon recovery because there is less vapor traffic in the lower pressure column due to a reduction in the introduction of nitrogen-rich vapor into the lower pressure column. This improves the liquid to vapor ratio in the lower pressure column above the point at which the argon and oxygen containing stream is taken for rectification in the argon column.

As will be apparent from the discussion below, the present invention provides an improved method of separating air in a multiple column arrangement in which argon recovery is improved by increasing the liquid to vapor ratio within the uppermost portion of lower pressure column.

SUMMARY OF THE INVENTION

The present invention provides a method of separating air. In accordance with such method, argon, oxygen and nitrogen that are contained in at least one compressed, purified and cooled stream are fractionated in an air separation system having a multiple column arrangement.

The multiple column arrangement includes a higher pressure column and a low pressure column to produce oxygen-rich and nitrogen-rich fractions of the at least one compressed, purified and cooled stream. An argon column is included in the multiple column arrangement that is connected to the lower pressure column to receive an argon and oxygen-containing vapor stream and thereby to produce an argon-rich fraction as an argon-rich column overhead within the argon column for recovery of the argon.

As used herein and in the claims, the term "column" means a single column or two or more columns in which an ascending vapor phase introduced into the column is contacted by mass transfer-contacting elements, such as structured packing or sieve trays, with a descending liquid phase. The ascending vapor phase becomes evermore rich in the lower boiling components of the mixture to be rectified while the liquid phase becomes evermore rich in the lower boiling components. These "higher" and "lower" boiling components are often referred to in the art as the "light" and "heavy" components of the mixture to be separated. The higher and lower pressure columns may be operatively associated with one another in a heat transfer relationship by a condenser-reboiler incorporated so that the higher and lower pressure columns form part of a single unit. The use of a separate condenser-reboiler contained within a separate shell is a further possibility for carrying out the present invention.

A two-phase stream containing a nitrogen-rich vapor phase and a liquid phase is formed by expanding at least part of a crude liquid oxygen column bottom stream composed of the liquid oxygen column bottoms formed within the higher pressure column. In an application of the present invention in which a liquid air stream is produced within the air separation system as a result of vaporization of a pressurized liquid stream made up of at least one of a liquid oxygen fraction and a liquid nitrogen fraction produced by the multiple column arrangement, the liquid stream can be composed of either the crude liquid oxygen column bottom stream or the liquid air stream. At least part of the nitrogen-rich vapor phase is disengaged from the liquid phase. At least part of a nitrogen-rich vapor stream that is composed of the nitrogen-rich phase is recompressed and recycled back to the multiple column arrangement of the air separation system. At least part of a liquid stream, that is composed of the liquid phase disengaged from the nitrogen-rich vapor phase, is introduced into the lower pressure column if derived from the crude liquid oxygen column bottom stream or into either or both of the higher or lower pressure column if derived from the liquid air stream. The diversion of the nitrogen vapor contained in the nitrogen-rich fraction from the stream that is introduced into the lower pressure column, for example, the crude liquid oxygen stream after partial vaporization, decreases the nitrogen traffic in the lower pressure column and in so doing increases the liquid to vapor ratio within the lower pressure column at a point thereof above which the argon and oxygen-containing vapor is removed from the lower pressure column, thereby to increase the argon within the argon and oxygen-containing vapor stream and therefore the argon-rich fraction able to be recovered within the argon column.

Preferably, the nitrogen-rich vapor stream or at least the portion that is to be recompressed is warmed prior to being recompressed in a main heat exchanger of the air separation system that is also used to cool at least one compressed and purified stream and thereby form the at least one compressed, purified and cooled stream. This allows recovery of the refrigeration produced by the expansion that is used to form the two-phase stream. Also, preferably the nitrogen-rich vapor stream comprises nitrogen in a proportion not deviating by more than about fifteen percent from that of ambient air used in forming the at least one compressed, purified and cooled stream. The nitrogen-rich vapor stream or part thereof can then be introduced into a compression unit of the air separation system that is used in compressing an air stream composed of the ambient air, thereby to form a compressed stream. The compressed stream is purified and at least one compressed purified stream formed by the compressed stream after having been purified is cooled in the main heat exchanger to form the at least one compressed, purified and cooled stream. Typically, a compressor is a multi-stage unit having a plurality of stages with inter-stage cooling between stages. This allows the nitrogen-rich vapor stream to be introduced into such a compressor along with the air to save capital costs would necessarily be incurred in providing a separate compressor for compressing the nitrogen-rich vapor stream.

In case of liquid pumping, the pressurized liquid stream can be produced by pumping a liquid oxygen stream composed of a liquid oxygen column bottoms produced in the lower pressure column. The pressurized liquid is vaporized in the main heat exchanger to form an oxygen product. The at least one compressed and purified stream can be one stream that is divided into first and second subsidiary streams. The second subsidiary stream can be compressed to a higher pressure within a booster compressor. The first subsidiary stream and the second subsidiary stream are then cooled within the main heat exchanger of the air separation system, thereby to create a major liquid fraction within the second subsidiary stream and therefore the liquid air stream as a result of the vaporization of the liquid oxygen stream.

The first subsidiary stream and at least part of the second subsidiary stream are introduced into the higher pressure column. As discussed above, this exacerbates the problem, outlined above, not having a sufficient reflux in the low pressure column above which the argon and oxygen-containing vapor stream is removed. Where a pumped liquid oxygen product is produced, the second subsidiary stream can be divided into first and second portions that are respectively introduced into the higher pressure column and the lower pressure column. The second subsidiary stream is expanded to a pressure suitable for introduction of the first portion into the higher pressure column and the second portion is expanded to a lower pressure, suitable for introduction of the second subsidiary stream into the lower pressure column. The two-phase stream can then be formed from the liquid column bottoms stream. The liquid phase stream is introduced into a condenser associated with the argon column to condense part of the argon-rich vapor to reflux the argon column, thereby partially vaporizing the liquid phase into vapor and liquid fractions. Streams of the liquid vapor and liquid fractions are then introduced into the lower pressure column.

A two-phase stream can be formed from the second subsidiary stream. In such case, the liquid phase stream is pumped and divided into first and second subsidiary liquid phase streams. The first of the subsidiary liquid phase streams can be expanded and introduced into the lower pressure column, thereby to constitute the at least part of the liquid phase stream introduced into the lower pressure column. The second of the subsidiary liquid phase streams can be introduced into the higher pressure column.

In any embodiment, a nitrogen product stream can be formed of column overhead within the lower pressure column and a waste nitrogen stream having a lower nitrogen purity than the nitrogen product stream can also be produced in the lower pressure column. Both streams are extracted from the lower pressure column. A liquid nitrogen reflux stream composed of condensed column overhead produced in the higher pressure column is cooled by indirectly exchanging heat to the nitrogen product stream and the waste nitrogen stream and then introduced as reflux into the lower pressure column. The nitrogen product stream and the waste nitrogen stream after having cooled the liquid stream are warmed within the main heat exchanger.

In any embodiment, the first subsidiary stream can be expanded with the performance of work. Such work can be recovered in a machine that can be used to compress the first subsidiary stream. However, the work could also be used elsewhere in the system. This expansion cools the first subsidiary stream to refrigerate the air separation system.

BRIEF DESCRIPTION OF THE DRAWINGS

While the specification concludes with claims distinctly pointing out the subject matter that Applicant regards as his invention, it is believed that the invention will be better understood when taken in connection with the accompanying drawings in which:

DETAILED DESCRIPTION

Figure 1:
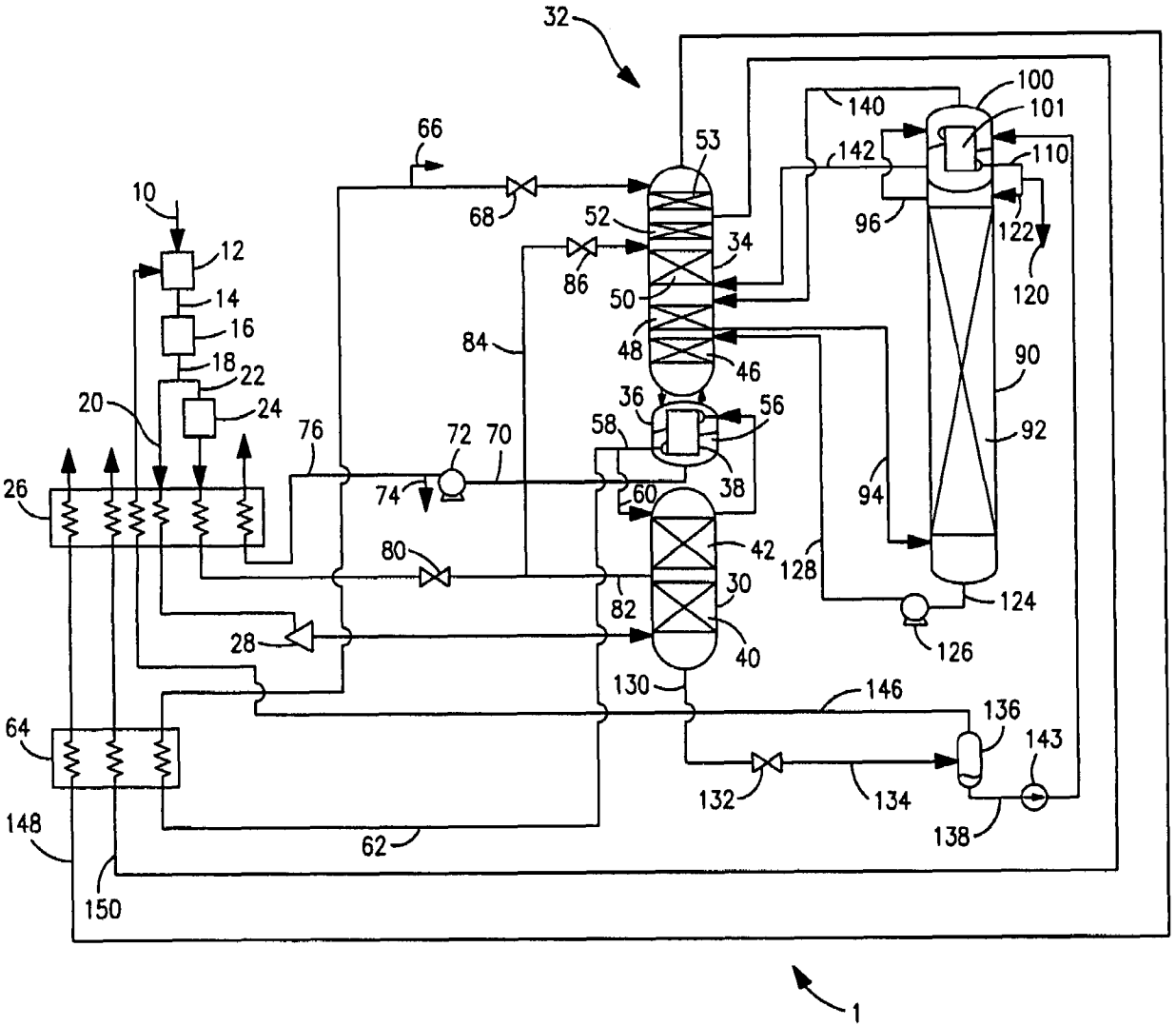
FIG. 1 is a schematic diagram of an apparatus that can be used to carry out a method in accordance with the present invention.

With reference to FIG. 1, an air separation system 1 is illustrated that is designed to produce high purity nitrogen product and a high pressure oxygen product as well as optionally a liquid oxygen product. It is understood, however, that this is for explanation purposes only and the present invention would have equal applicability to a system in which a high pressure oxygen product were not produced.

Air separation system 1 is designed to fractionate, argon, oxygen and nitrogen that is contained within a feed air stream 10. Feed air stream 10 is compressed within a compression unit 12 that may encompass numerous stages of compression with inter-stage cooling. The compression of feed air stream 10 produces compressed stream 14 that is purified within a purification unit 16. Purification unit 16 removes the high boiling contaminants that are present within feed air stream 10 such as carbon dioxide, water, and potentially carbon monoxide. Such a unit can be a temperature swing adsorption unit having beds of alumina and/or molecular sieve adsorbent operating out of phase to adsorb such contaminants present within the feed air stream 10. The purification produces a compressed and purified stream 18.

Compressed and purified stream 18 is divided into first and second subsidiary streams 20 and 22. Typically, first subsidiary stream 20 constitutes between about 65 percent and about 70 percent of compressed and purified stream 18. Second subsidiary stream 22 constitutes between about 30 percent and about 35 percent of compressed and purified stream 18. Second subsidiary stream 22 is then compressed within booster compressor 24 to enable vaporization of the pumped and pressurized liquid oxygen product that will be discussed hereinafter.

Air separation system 1 is provided with a main heat exchanger 26 that typically is one or more units of plate-fin design. First subsidiary stream 20 is cooled within main heat exchanger 26, typically to a temperature in a range of between about 125° K and about 190° K. Thereafter, first subsidiary stream 20 is expanded within a turboexpander 28 to a temperature at or near the dew point and of a pressure compatible with higher pressure column 30. The expanded second subsidiary stream 20 is then introduced into the base of the higher pressure column 30 as the primary air feed. It is understood that turboexpander 28 expands with a performance of work. Although not shown, such work would typically be applied to a compressor that would compress first subsidiary stream 20.

Higher pressure column 30 is part of a multiple column arrangement 32 that also has a lower pressure column 34 operatively associated with higher pressure column 30 via a condenser reboiler 36 having a core 38 located within a shell thereof. Lower pressure column 34 is so named because it operates at a lower pressure than the higher pressure column 30. As indicated previously, both higher pressure column 30 and higher pressure column 34 could be a series of connected columns. Each of the higher pressure and lower pressure columns 30 and 34 contain mass transfer contact elements 40 and 42 for higher pressure column 30 and 46, 48, 50, 52 and 53 for lower pressure column 34.

Condenser reboiler 36 could be integrated into the columns and the higher and lower pressure columns 30 and 34 as known in the art. Condenser reboiler 36 serves to condense a nitrogen column overhead that collects within the top of higher pressure column 30 against a vaporizing liquid oxygen column bottoms that is produced within the lower pressure column 34 and that collects as liquid oxygen column bottoms 56 within condenser-reboiler 36. A condensed nitrogen stream 58, made up of the nitrogen column overhead is divided into first nitrogen reflux stream 60 that is used to reflux the higher pressure column 30 and a second nitrogen reflux stream 62 that is further cooled within an exchanger 64. Part of second nitrogen reflux stream 62 may be taken thereafter as a nitrogen product stream 66. However, all of second nitrogen reflux stream 62 can be expanded by a Joule-Thompson valve 68 to the pressure of lower pressure column 34 and is then used to reflux the lower pressure column 34.

In higher pressure column 30, first subsidiary stream after having been expanded within turboexpander 28 and introduced into higher pressure column 30 produces an ascending vapor phase that becomes evermore rich in the lower boiling or light components, nitrogen, for example, as it ascends the mass transfer elements 40 and 42 to form the nitrogen column overhead within higher pressure column 30. The vaporized liquid oxygen column bottoms 56 forms an ascending vapor phase within lower pressure column 34 that becomes evermore rich in the lighter component, nitrogen. The descending liquid phase, that is initiated by second nitrogen reflux stream 62, becomes evermore rich in oxygen, the heavier or less volatile component.

As indicated previously, air separation system 1 is designed to produce a high pressure oxygen product. As such, an oxygen stream 70 composed of the liquid oxygen column bottoms 56 produced within lower pressure column 34 is pressurized by being pumped by a pump 72. Pressurized liquid may be extracted in part as a pressurized liquid oxygen stream 74. However, the remaining portion 76, which could be the entire portion of liquid stream 70 if pressurized liquid product stream 74 were not removed, is vaporized within the main heat exchanger 26 against liquefying second subsidiary stream 22.

Second subsidiary stream 22, after having been compressed and cooled, is expanded to the pressure of higher pressure column 30 by way of a Joule-Thompson valve 80 and then divided into first and second portions 82 and 84. Portion 82 is introduced into an intermediate location of higher pressure column 30 as a saturated liquid. Portion 84 is also expanded via a Joule-Thompson valve 86 and is introduced into lower pressure column 34 as a two-phase stream within an intermediate location thereof of appropriate concentration to such stream.

Air separation system 1 and multiple column arrangement 32 thereof also includes an argon column 90 that is provided with mass transfer contact elements 92 to contact an ascending vapor phase with a descending liquid phase formed within argon column 90. An argon and oxygen-containing vapor stream 94 is introduced into argon column 90 to produce an ascending vapor phase to separate the oxygen. Argon column 90 operates at a pressure comparable to lower pressure column 34. Argon and oxygen-containing vapor stream 94 can be rectified within argon column 90 to produce nearly pure argon-rich fraction as an argon-rich column overhead. An overhead stream 96 composed of the argon-rich column overhead is condensed within a condenser 100 having a core 101. The resulting liquid argon-rich stream 110 is divided into a first portion 120 that can be taken as a product and a second reflux portion 122 that is used to reflux argon column 90. An argon depleted oxygen-rich column bottoms 124 is formed within argon column 90 and is pumped by a pump 126 back to the lower pressure column 34 as a stream 128.

Heat transfer duty within the condenser 100 is taken up by part of the crude liquid oxygen column bottoms produced within a higher pressure column 30. However, as indicated previously, the removal of the liquid oxygen product stream 70 and its resultant pressurization to produce the pressurized oxygen product, will result in liquefaction of not an inconsiderable part of the incoming air stream. This will result in less nitrogen vapor being introduced into higher pressure column 30 that will in turn result in less nitrogen reflux being introduced into lower pressure column 34 by way of second nitrogen reflux stream 62. At the same time, if a stream composed of all of the crude liquid oxygen were used to condense argon within the argon column, the nitrogen traffic would be increased in the lower pressure column 34 resulting in less argon being washed down to a stage where it could be removed as argon-oxygen containing vapor stream 94 for eventual recovery. Hence, the problem is simply exacerbated when a liquid oxygen product is pressurized and then vaporized within the main heat exchanger.

In order to overcome such problem, in the present invention, a crude liquid oxygen stream 130 is valve expanded within a Joule-Thompson valve 132 to produce a two-phase stream 134. The vapor phase, which is a nitrogen-rich vapor phase, is disengaged from the liquid phase within phase separator 136. A liquid stream 138 composed of the liquid phase is then introduced into condenser 100 to produce streams 140 and 142 composed of the vapor and liquid fractions, respectively, due to the partial vaporization of liquid phase stream 138. However, since the flashed vapor stream 146 has been removed prior to entry into the condenser 100 there will be less nitrogen traffic in the top of lower pressure column 34, thereby increasing the liquid to vapor ratio within lower pressure column 34 in a region above which argon and oxygen-containing vapor stream 94 is removed. It is to be noted here that although one phase separator is shown, there could be successive stages of flash separation in which the liquid produced in an upstream phase separator were subsequently valve expanded and introduced into a downstream phase separator to produce the liquid phase stream from the downstream phase separator.

Liquid stream 138 is typically pumped by a pump 143 back to the condenser 100. It is to be noted that not all of the liquid stream 138 need be sent to the argon condenser. A portion could be sent to the lower pressure column 34 directly. Furthermore, liquid stream 138 could be sent directly to the column with another of other known streams that could be used in connection with condenser 100. In the illustrated embodiment, a piping run serves to lower the pressure of liquid stream 138 to a pressure suitable for introduction of streams 140 and 142 into lower pressure column 134. The pumping is necessary due to the length of the argon column and its design in producing a pure argon product. Hence, there may not be enough pressure within a high pressure column to bring it up to a level of condenser 100. However, the invention is not limited to this specific embodiment and if a crude argon fraction were to be further processed in a shorter column, there might be sufficient pressure to drive liquid stream 138 into condenser 100. In such case, a Joule-Thompson valve would have to be used to lower the pressure and thereby to allow for such introduction of streams 140 and 142 into lower pressure column 34.

A nitrogen-rich stream 146 that is composed of the nitrogen-rich fraction is warmed in the main heat exchanger 26 and then introduced into an appropriate stage of compression unit 12. This is possible where the nitrogen-rich stream 146 has a composition in which the nitrogen component is not more than about fifteen percent of that present within the air, plus or minus. It is to be noted, that it is possible to cold compress nitrogen-rich stream 146, although this would be disadvantageous in that its refrigeration value would thereby be lost. A further possibility is that not all of the nitrogen-rich stream need be recompressed. In fact, the present invention contemplates that only part of such stream or streams, if two or more flash separation stages are used, is recycled back for compression. The remaining portion in an appropriate case could be valve or work expanded and then vented or sent back to the columns.

It is to be further noted, that a nitrogen-rich stream 148 and a waste nitrogen stream 150 having a lower nitrogen concentration of nitrogen-rich stream 148 may be extracted from the top and at a lower location of lower pressure column 34. These streams are warmed in heat exchanger 64 and the main heat exchanger 26 to cool the second nitrogen reflux stream 64 and to also, help cool the incoming streams.

Figure 2:
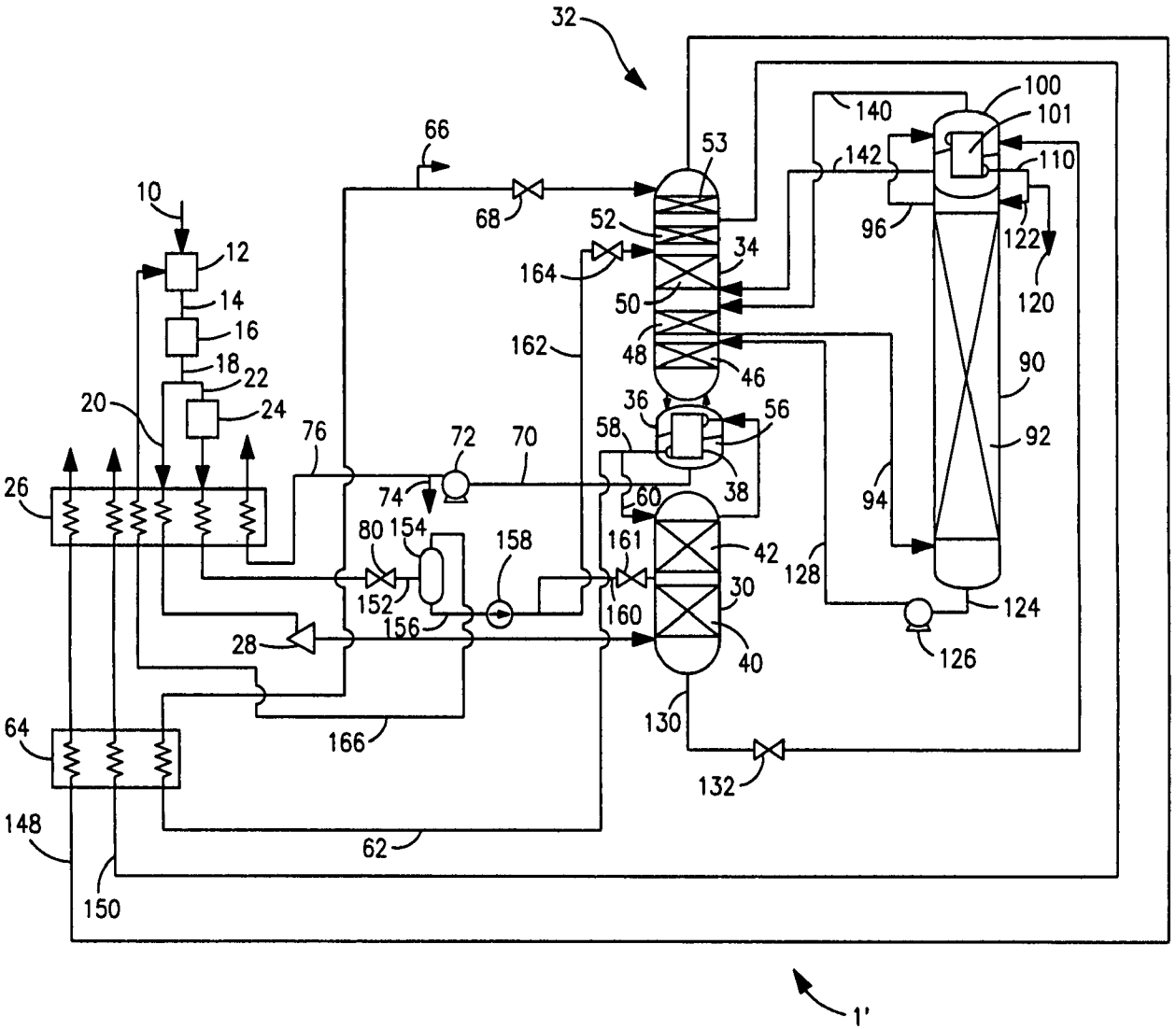
FIG. 2 is an alternative embodiment of FIG. 1.

With reference to FIG. 2, in an alternative embodiment of air separation system 1, illustrated with respect to an air separation system 1', the crude liquid oxygen stream 130 is expanded within a valve 132 and then introduced into the argon column condenser 100 to produce streams 140 and 142. In this embodiment, the second subsidiary air stream 22 after having been cooled, liquefied and valve expanded within valve 80 is used to produce a two-phase stream 152 that is phase separated within phase separator 154 to a liquid stream 156 composed of the liquid fraction can be pumped within a pump 158 or valve expanded by a valve. A first portion 160 after being valve expanded within a valve 161 to the pressure of the higher pressure column is then introduced into an intermediate location of a higher pressure column 30. A second portion 162 after having been valve expanded by valve 164 to the pressure of the lower pressure column 34 is then introduced into the lower pressure column 34. It is to be noted that all of the liquid stream 156 could be introduced into either the higher pressure column 30 or the lower pressure column 34. A nitrogen-rich stream 166 composed of the nitrogen-rich phase is then warmed within main heat exchanger 26 and recycled to compressor unit 12. Air separation system 1' otherwise operates in a similar manner to air separation system 1 and therefore, the explanation of elements having the same reference numbers will not be repeated.

While the present invention has been described with reference to a preferred embodiment, as will occur to those skilled in the art, numerous changes, additions and omissions can be made without departing from the spirit and the scope of the present invention.

I claim:

1. A method of separating air comprising:

fractionating argon, oxygen and nitrogen contained in at least one compressed, purified and cooled stream in an air separation system having a multiple column arrangement including a higher pressure column and a lower pressure column to separate the air into oxygen-rich and nitrogen-rich fractions and an argon column connected to the lower pressure column to receive an argon and oxygen-containing vapor stream and thereby to produce an argon-rich fraction as an argon-rich column overhead within said argon column for recovery of the argon;

forming a two-phase stream containing a nitrogen-rich vapor phase and a liquid phase by expanding at least part of a crude liquid oxygen column bottoms stream composed of a liquid oxygen column bottoms formed within the higher pressure column;

disengaging at least part of the nitrogen-rich vapor phase from the liquid phase;

recompressing at least a portion of said nitrogen-rich vapor stream composed of the nitrogen-rich vapor phase and recycling the at least a portion of the nitrogen-rich vapor stream for fractionation in the multiple column arrangement of the air separation system; and introducing at least part of a liquid stream composed of the liquid phase disengaged from the nitrogen-rich vapor phase into the lower pressure column.

2. A method of separating air comprising:

fractionating argon, oxygen and nitrogen contained in at least one compressed, purified and cooled stream in an air separation system having a multiple column arrangement including a higher pressure column and a lower pressure column to separate the air into oxygen-rich and nitrogen-rich fractions and an argon column connected to the lower pressure column to receive an argon and oxygen-containing vapor stream and thereby to produce an argon-rich fraction as an argon-rich column overhead within said argon column for recovery of the argon;

forming a two-phase stream containing a nitrogen-rich vapor phase and a liquid phase by expanding a liquid air stream or a crude liquid oxygen column bottoms stream composed of a liquid oxygen column bottoms formed within the higher pressure column, the liquid air stream being produced within the air separation system as a result of vaporization of a pressurized liquid stream made up of at least one of a liquid oxygen fraction and a liquid nitrogen fraction produced by the multiple column arrangement;

disengaging at least part of the nitrogen-rich vapor phase from the liquid phase;

recompressing said at least a portion of said nitrogen-rich vapor stream composed of the nitrogen-rich vapor phase and recycling the at least a portion of the nitrogen-rich vapor stream for fractionation in the multiple column arrangement of the air separation system; and introducing at least part of a liquid stream composed of the liquid phase disengaged from the nitrogen-rich vapor phase into at least one of the lower pressure column and the higher pressure column.

3. The method of claim 1, wherein the at least a portion of the nitrogen-rich vapor stream is warmed, prior to being recompressed, in a main heat exchanger of the air separation system that is also used to cool at least one compressed and purified stream used in forming the at least one compressed, purified and cooled stream.

4. The method of claim 3, wherein:

the nitrogen-rich vapor stream comprises nitrogen in a proportion not deviating from that of air by more than about fifteen percent; and the at least a portion of a nitrogen-rich vapor is introduced into a compression unit of the air separation system that is used in compressing an air stream composed of the ambient air, thereby to form a compressed stream used in forming the at least one compressed and purified stream.

5. The method of claim 2, wherein the at least a portion of the nitrogen-rich vapor stream is warmed, prior to being recompressed, in a main heat exchanger of the air separation system that is also used to cool at least one compressed and purified stream used in forming the at least one compressed, purified and cooled stream.

6. The method of claim 5, wherein:

the nitrogen-rich vapor stream comprises nitrogen in a proportion not deviating from that of air by more than about fifteen percent; and the at least the portion of a nitrogen-rich vapor is introduced into a compression unit of the air separation system that is used in compressing an air stream composed of the ambient air, thereby to form a compressed stream used in forming the at least one compressed and purified stream.

7. The method of claim 6, wherein:

the pressurized liquid stream is produced by pumping a liquid oxygen stream composed of a liquid oxygen column bottoms produced in the lower pressure column;

the pressurized liquid is vaporized in the main heat exchanger to form an oxygen product;

the at least one compressed and purified stream is one compressed and purified stream divided into first and second subsidiary streams;

the second subsidiary stream is compressed to a higher pressure within a booster compressor;

the first subsidiary stream and second subsidiary stream are cooled within a main heat exchanger of the air separation system, thereby to create a major liquid fraction within the second subsidiary stream and therefore the liquid air stream as a result of the vaporization of the liquid oxygen stream; and the first subsidiary stream and at least part of the second subsidiary stream are introduced into the higher pressure column.

8. The method of claim 7, wherein:

the second subsidiary stream is divided into first and second portions that are respectively introduced into the higher pressure column and the lower pressure column;

the second subsidiary stream is expanded to a pressure suitable for introduction of the first portion into the higher pressure column and the second portion is expanded to a lower pressure, suitable for introduction of the second subsidiary stream into the lower pressure column;

the two phase stream is formed from the liquid column bottoms stream;

the liquid phase stream is introduced into a condenser associated with the argon column to condense part of the argon-rich vapor to reflux the argon column, thereby partially vaporizing the liquid phase stream into vapor and liquid fractions; and streams of the vapor and liquid fractions are introduced into the lower pressure column.

9. The method of claim 7, wherein:

the two phase stream is formed from the second subsidiary stream;

the liquid phase stream is pumped and then divided into first and second subsidiary liquid phase streams;

the first of the subsidiary liquid phase streams is expanded and introduced into the lower pressure column, thereby to constitute the at least part of the liquid phase stream introduced into the lower pressure column; and the second of the subsidiary liquid phase streams is introduced into the higher pressure column.

10. The method of claim 8 or claim 9, wherein:

a nitrogen product stream formed of column overhead within the lower pressure column and a waste nitrogen stream having a lower nitrogen purity than said nitrogen product stream are extracted from the lower pressure column;

a liquid nitrogen reflux stream composed of condensed column overhead produced in the higher pressure column is cooled by indirectly exchanging heat to the nitrogen product stream and the waste nitrogen stream and then introduced as reflux into the lower pressure column; and the nitrogen product stream and the waste nitrogen stream after having cooled the liquid stream are warmed within the main heat exchanger.

11. The method of claim 10, wherein the first subsidiary stream is expanded with performance of work.

* * * * *